US007315778B1

(12) United States Patent
Kumar

(10) Patent No.: US 7,315,778 B1
(45) Date of Patent: Jan. 1, 2008

(54) SYSTEM AND METHOD FOR DETECTING AND RESPONDING TO FUGITIVE FUELING OF AN INTERNAL COMBUSTION ENGINE

(75) Inventor: Ajith Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/468,378

(22) Filed: Aug. 30, 2006

(51) Int. Cl.
*F02D 41/30* (2006.01)
*F02M 59/20* (2006.01)

(52) U.S. Cl. ..... 701/104; 123/357; 123/480

(58) Field of Classification Search ..... 701/102, 701/103, 104, 112; 123/333, 357, 358, 480, 123/478, 198 DB, 198 D, 198 C
See application file for complete search history.

(56) References Cited

U.S. PATENT DOCUMENTS 6,363,315 B1 * 3/2002 Love et al. ..... 701/104
6,429,540 B1 8/2002 Dunsworth et al.
6,522,439 B2 2/2003 Price et al.
6,772,060 B2 * 8/2004 McCauley et al. ..... 701/104
6,848,426 B2 * 2/2005 Kumar et al. ..... 123/480

* cited by examiner

*Primary Examiner*—Stephen K. Cronin
*Assistant Examiner*—Johnny H. Hoang
(74) *Attorney, Agent, or Firm*—Carlos L. Hanze; Dickinson Wright PLLC

(57) ABSTRACT

A method and system for detecting and responding to fugitive fueling of a reciprocating internal combustion engine use a controller to determine the actual power output of an engine, as well as a predicted power output based on fuel provided by the engine's fuel system. An engine controller may determine a presence of fugitive fueling by comparing the predicted output with the actual output, and prompt an emergency shutdown sequence if the actual engine output exceeds the predicted power output.

18 Claims, 7 Drawing Sheets

SYSTEM AND METHOD FOR DETECTING AND RESPONDING TO FUGITIVE FUELING OF AN INTERNAL COMBUSTION ENGINE

FIELD OF THE INVENTION

The field of the invention relates to the detection and response to the presence of unwanted fueling of an internal combustion engine.

BACKGROUND OF THE INVENTION

As used herein, the term "fugitive fueling" means the phenomenon in which an engine receives fuel in excess of that which a fuel controller intends to deliver, either by injectors or by another fuel delivery device. Fugitive fueling may occur in a variety of situations. For example, if an engine is operated in a hydrocarbon-contaminated atmosphere, such as could occur in the event of a spill at a petroleum transfer terminal or a recycling facility, sufficient unwanted, or fugitive, hydrocarbon may be inducted by the air system of an engine to cause overspeed and severe engine damage. A mishap such as a vehicular accident or train wreck may create a fugitive fueling situation, too.

Another type of fugitive fueling may occur due to a leak in an engine lubrication system. Such a leak may occur in a turbocharger or other component connected with the engine's air inlet system. Those skilled in the art will appreciate that engines, particularly diesel engines, are capable of operating quite well on lubricating oil, including lubricating oil aspirated into the engine's cylinders as a result of leaking turbocharger seals or worn valve guides. Yet another type of fugitive fueling may occur if a fuel system injector is severely impaired such that the injector either flows more than it is intended to flow, or simply leaks. This sort of impairment will most likely occur with an unthrottled engine having fuel injection, but could occur with a carbureted engine as well.

U.S. Pat. Nos. 6,429,540 and 6,522,439, which are assigned to the assignee of the present invention address methods for responding to an engine overspeed condition resulting from ingestion of lube oil into an engine's cylinders.

A need exists for a system and method that detect fugitive fueling before an engine overspeeds, so as to allow an engine to be stopped before uncontrollable operation occurs.

BRIEF DESCRIPTION OF THE INVENTION

An embodiment of a system for detecting and responding to fugitive fueling of a reciprocating internal combustion engine includes a fuel supply system for furnishing fuel to the engine's cylinders, with the fuel system including at least one fuel injector for furnishing fuel to the engine during a predetermined period of time. An engine output measuring device determines the engine's work output during the predetermined period of time. A controller, which is operatively connected with the fuel supply system and with the engine output measuring device, predicts the quantity of fuel which the engine should consume during the period of time, based upon the engine's work output. The controller compares either the actual, or an estimated quantity of fuel furnished by the fuel supply system during the predetermined period of time with the engine's work output during the same period of time. The controller sets a fugitive fueling flag if the furnished quantity of fuel is less than the predicted quantity of fuel. The controller preferably directs the fuel supply system to shut off fuel to the engine in the event that the fugitive fueling flag is set.

In a diagnostic sequence, the controller periodically commands the fuel supply system to change the fuel rate, while determining the engine's resulting change in work output, so as to determine the engine's responsiveness to changes in fuel rate. The controller sets the fugitive fueling flag if the engine's work output does not change in accord with the commanded change in the fuel rate. As an alternative, the controller may use engine load changes which inherently occur as the basis for determining the presence, if any, of fugitive fueling.

In another embodiment of the present invention, the controller directs the fuel supply system to shut off fuel in the event that the fugitive fueling flag is set; the controller thereafter engages an emergency shutdown system in the event that the engine does not stop when the fuel is shut off. The emergency shutdown system may include a rotating electrical machine coupled to the engine, with the rotating electrical machine having sufficient power absorbing capacity to stop the engine. As an alternative, the emergency shutdown system may include an air shutter for cutting off the flow of combustion air to the engine. As yet another alternative, the emergency shutdown system may include a source of inert gas which may be introduced to the engine so as to exclude combustion air from the engine cylinders.

In another embodiment of the present invention, an engine output measuring device may include a rotating electrical machine coupled to the engine, with the rotating electrical machine coupled to a variable and controllable load, such that the rotating electrical machine is operated as a dynamometer. This load may be used to bring the engine speed down in case of uncontrolled fugitive fueling, in order to eliminate damage due to either overspeeding or to other internal engine system impairment.

In another embodiment of the present invention, the engine's fuel supply system further includes at least one sensor for directly or indirectly measuring the fuel consumed by the engine during a period of time, with the sensor being coupled to an engine controller.

In another embodiment of the present invention, a method for detecting and responding to fugitive fueling of a reciprocating internal combustion engine includes measuring the fuel consumed by the engine during a period of time, and determining the engine's work output during the period of time. Then, the method predicts the quantity of fuel which the engine should have consumed during the predetermined period of time, based upon the engine's work output. The actual quantity of fuel consumed during the period of time is compared with predicted fuel consumption, and a fugitive fueling response is initiated the event that the actual quantity of fuel consumed is less than the predicted quantity of fuel. The fugitive fueling response includes the steps of commanding the engine's fuel system either to shut off, or to greatly reduce, the flow of fuel to the engine, and to engage an emergency shutdown system if the engine does not stop after receiving either no fuel or a reduced quantity of fuel from the engine's fuel system.

In an embodiment in which an engine having the present system is coupled to a rotating electrical machine, the engine may be loaded by means by the rotating electrical machine, commonly an alternator, if a command to shut off the engine's fuel does not slow or stop the engine. In such case, a method of loading the engine with an electrical machine may include controlling the field current of the alternator, as well as imposing additional normal and/or auxiliary loads to maintain an increased level of power absorption as the speed of the engine decreases, and placing an adaptive load upon the alternator by means of a traction load to maximize or regulate the power drawn from the alternator. Additional active power absorbing/producing systems could also be used. A traction motor system may be used to control the link voltage applied to the passive load and to at least one traction motor. The alternator field current may be supplied by a bank of continuously firing rectifiers connected with a multi-phase input source. Alternatively, the alternator field current may be supplied by a direct current source. The traction motor may be operated either as a brake or as a motor so as to load the engine and thereby bring it to a stop. This method may also include controlling the alternator field current asynchronously.

It is advantage of a system and method according to the present invention that fugitive fueling may be detected before the engine reaches a runaway speed.

It is a further advantage of a system and method according to the present invention that costly engine damage may be avoided through judicious use of the present system and method.

It is a further advantage of a system and method according to the present invention that the inventive system may be implemented without the need of additional hardware in an engine, such as an over-speed governor.

Other advantages, as well as features of the present invention will become apparent to the reader of this specification.

DETAILED DESCRIPTION OF THE INVENTION

Figure 1:
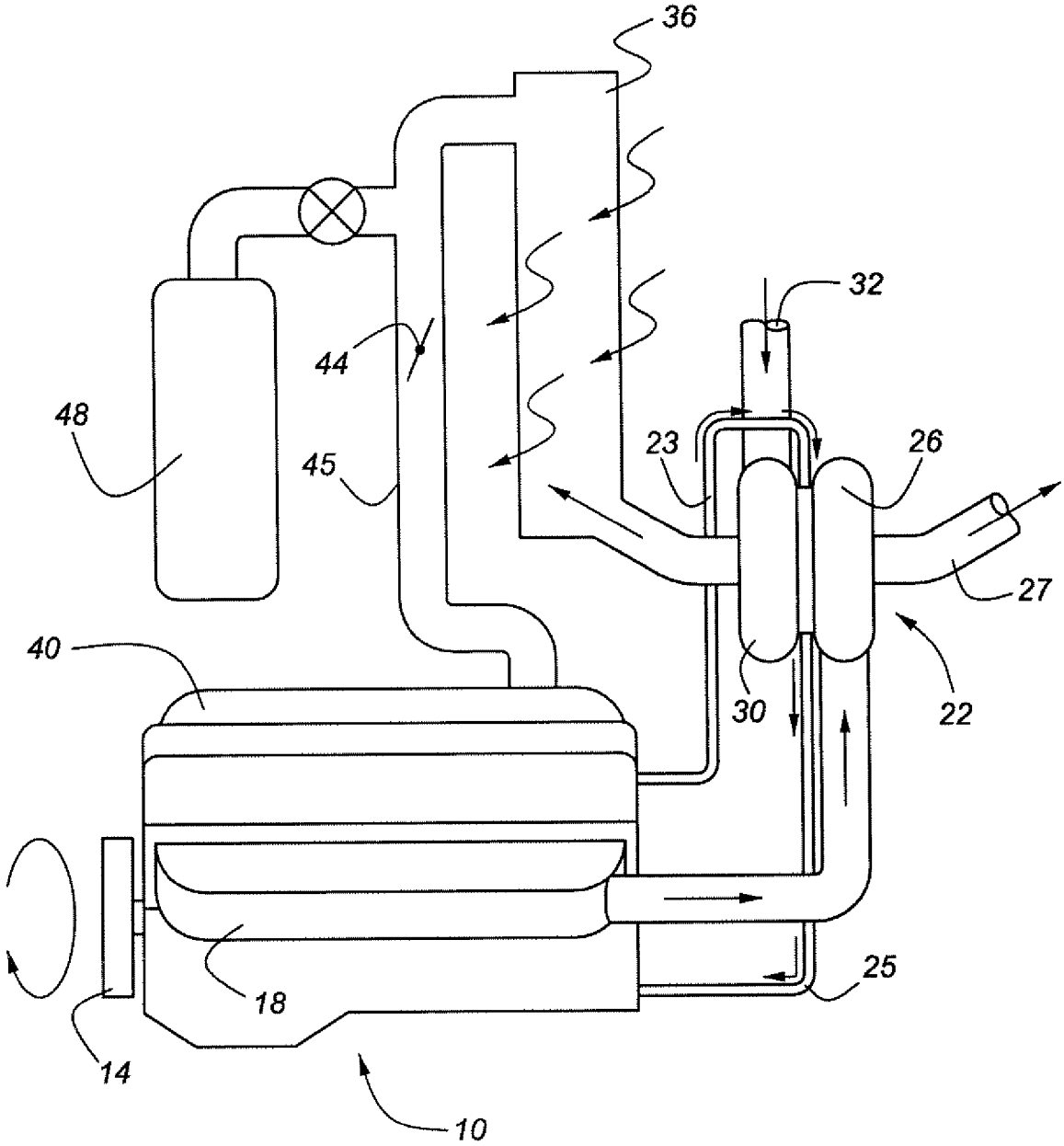
FIG. 1 is a schematic representation of an engine having a system for detecting and responding to fugitive fueling according to an embodiment of the present invention.
Figure 2:
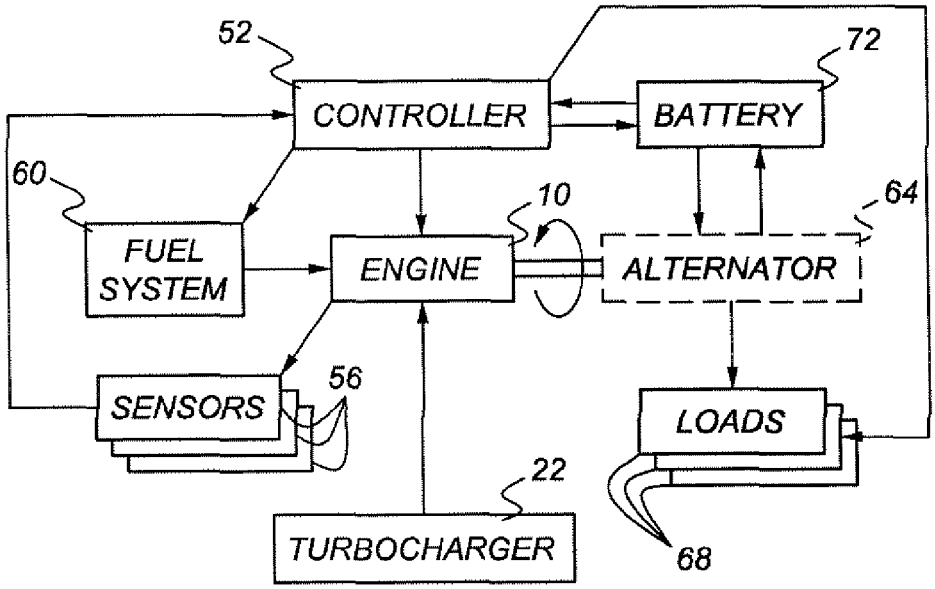
FIG. 2 is a block diagram representing a complete engine system according to an embodiment of the present invention.

As shown in FIG. 1, engine 10 has a crankshaft, 14, which is coupled with a load, such as alternator 64 shown in FIG. 2. Engine 10 has an exhaust-driven power adder embodied as turbocharger 22. Exhaust leaving engine 10 through exhaust manifold 18 flows past turbine 26, which drives compressor section 30 before exiting through exhaust pipe 27. Air drawn through air inlet 32 is compressed and flows through aftercooler 36 and then into intake manifold 40. Engine 10 includes two dedicated emergency shutdown devices, namely, air shutter 44 and inert gas source 48. Air shutter 44 is mounted movably within engine air inlet 45. If engine 10 cannot be stopped by other means, air shutter 44 may be rotated from an initial open position to a closed position which prevents air from reaching the engine's cylinders. Alternatively, inert gas supply 48 may be used to inject a non-combustible gas such as carbon dioxide, into the engine 10, so as to shut down the engine.

Turbocharger 22 is lubricated by oil flowing through line 23 from the engine's pressurized lubrication system. Oil flows through line 25 back to the lubrication system. Impairment of turbocharger 22 may result in fugitive fueling if any of the oil flowing through line 23 becomes induced into combustion air flowing through aftercooler 36 and intake manifold 40. This is but one of many potential sources of fugitive fueling.

FIG. 2 shows an embodiment of an engine fuel system 60, which is operated by controller 52. Fuel system 60 may include either a common rail injection setup, or camshaft-driven unit injectors, or yet other types of fuel systems known to those skilled in the art and suggested by this disclosure. Controller 52 is also connected with battery 72, which, in the case of a locomotive, may be either a traction battery, or other type of battery such as a starting battery or control system battery. Engine 10 powers alternator 64 in the present example, such as would be the case where engine 10 is installed in a diesel-electric locomotive. Alternator 64 has a number of loads, 68, attached thereto, which may include traction motors, dynamic brake grids, or other devices. FIG. 2 also shows turbocharger 22 and a number of sensors, 56, which measure a variety of operating parameters such as turbo speed, engine airflow, engine fuel delivery, and other parameters known to those skilled in the art and suggested by this disclosure.

Figure 3:
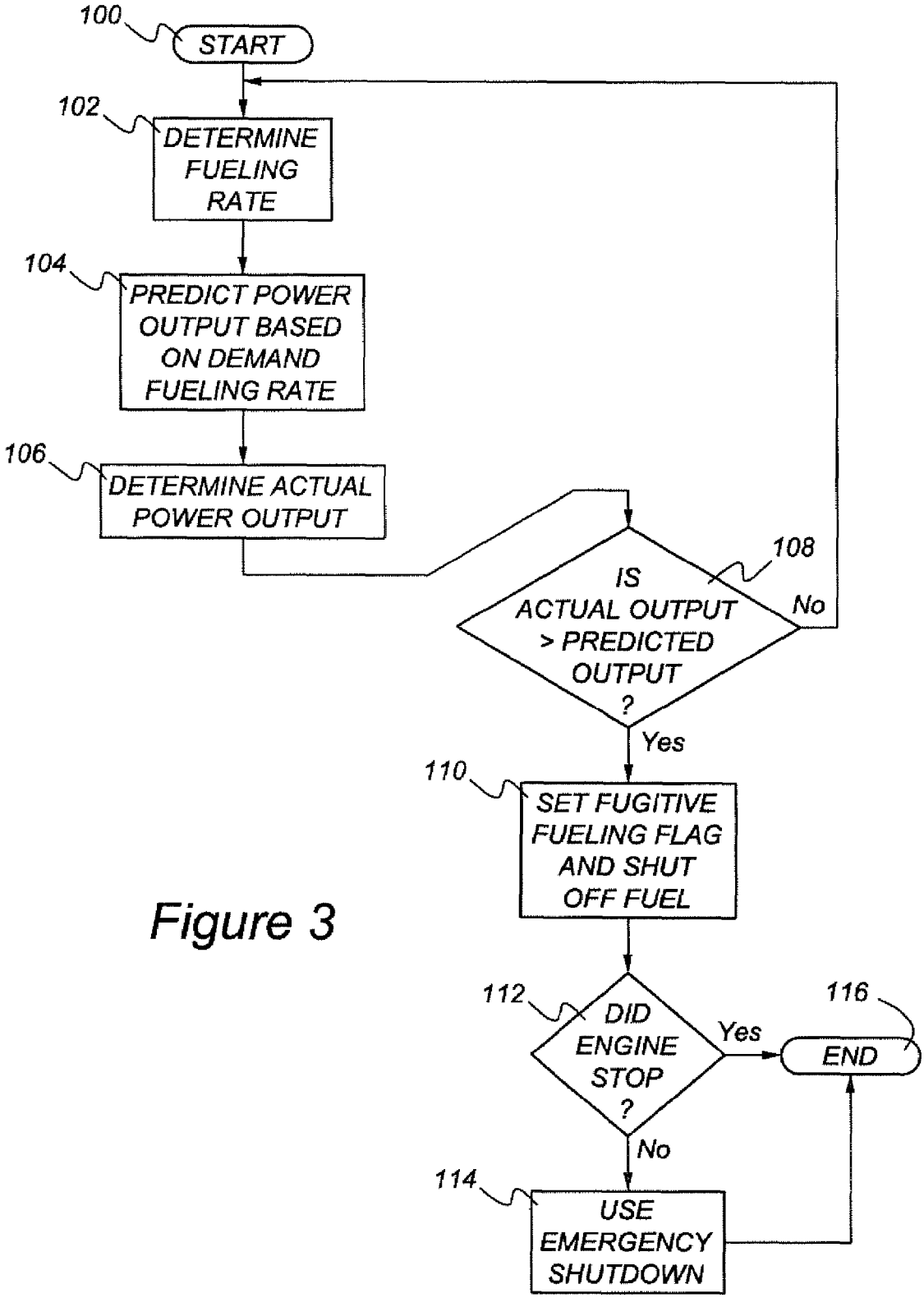
FIG. 3 is a flow diagram illustrating a diagnostic method according to an embodiment of the present invention.

FIG. 3 illustrates a method configured according to an embodiment of the present invention. Beginning at block 100 with a start command, the method moves to block 102, wherein the fueling rate of the engine 10 is determined. Fuel rate may be obtained from fuel system 60, which normally includes at least one fuel injector for furnishing fuel to the engine. More probably, a separate fuel injector will be employed for each cylinder, with the precise quantity of fuel per injector stroke being controlled by controller 52. Because controller 52 is operatively connected with fuel system 60, controller 52 is well-suited to determine the exact amount of fuel being delivered to engine 10 at any particular period of time.

The determination of fuel quantity delivered to the engine's cylinders by the fuel system could also be performed using an estimate based on injector opening time, as well as the shape of the injector map. In a diesel-powered locomotive, the effort level of a conventional speed regulator could also be employed for this purpose. The precision of the estimated fuel consumption value may be improved by correcting for ambient air pressure and temperature according to the correction factor $1/(((0.0005386*T)+0.96768)*(14.135/P)^{0.093}$, where T is the temperature is degrees F, and P is the absolute pressure in pounds per square inch. Additional compensation may be based on the energy content of the fuel.

After block 102, the method proceeds to block 104, wherein engine power output is predicted based on the previously determined fuel rate, according to models or a lookup table, or yet other methods known to those skilled in the art and suggested by this disclosure. Such lookup tables or analytical methods may include various factors such as trending/history (prior performance of the system at the same or comparable operating conditions) or operation of similarly designed systems.

After determining the predicted power output at block 104, the method moves to block 106, where the actual power output of engine 10 is determined. To do this, alternator 64 may be operated as a virtual dynamometer. In other words, knowing the operating parameters of alternator 64, such as rotational speed and alternator field current, it is possible for controller 52 to determine the precise power output of the engine 10. Another option is to monitor the output power by measuring the output voltage and current. Of course, power and work are related by time, and work output of engine 10 is merely the time integrated sum of its power output.

At block 108, the actual output of engine 10 is compared with the predicted output of the engine. If the actual power output, or work, is not greater than the predicted output, the routine recycles to block 102. If, however, the actual output is greater than the predicted output at block 108, the routine proceeds block 110, where controller 52 sets a fugitive fueling flag that prompts fuel system 60 to shut off fuel to engine 10. The comparison that occurs at block 108 may include thresholds or tolerances to account for inaccuracies in the data underlying the comparison. Moreover, transient capability may be part of the comparison.

At block 112, the method determines whether engine 10 stopped in response to the fugitive fueling flag. If engine 10 did stop, the method concludes at block 116. If, however, engine 10 is not stopped at block 112, the method moves to block 114, where emergency shutdown procedures are initiated. With certain engines, it may be desirable at block 110 to reduce fuel flow to an idle value, rather than to cut off the flow altogether. With other engines, emergency shut down procedures may be initiated simultaneously with the fuel shut off command.

Controller 52 may be programmed to periodically run through the routine of FIG. 3, so as to determine whether fugitive fueling is occurring prior to the onset of a runaway condition.

As noted above, the emergency shutdown process at block 114 may include use of air shutter 44, or inert gas supply 48, or alternator 64, or disc brake system included as one of loads 68. Engine 10 may be loaded with alternator 64 to quickly bring the engine to a halt by controlling the field current of alternator 64 so as to maintain power absorption at a high level as the speed of engine 10 decreases, while placing an adaptive load on the alternator by using both a passive load and a traction motor system. A traction motor drive may be employed to control the link voltage, which is applied to the passive load and to the traction motor. The alternator field current may be supplied by a bank of continuously firing rectifiers connected with a multi-phase input source, or with a direct current source. If this mode of emergency shutdown is used, traction motors, such as in a diesel electric locomotive or other large electrodrive vehicle, may be employed as either a brake or a motor.

Figure 4:
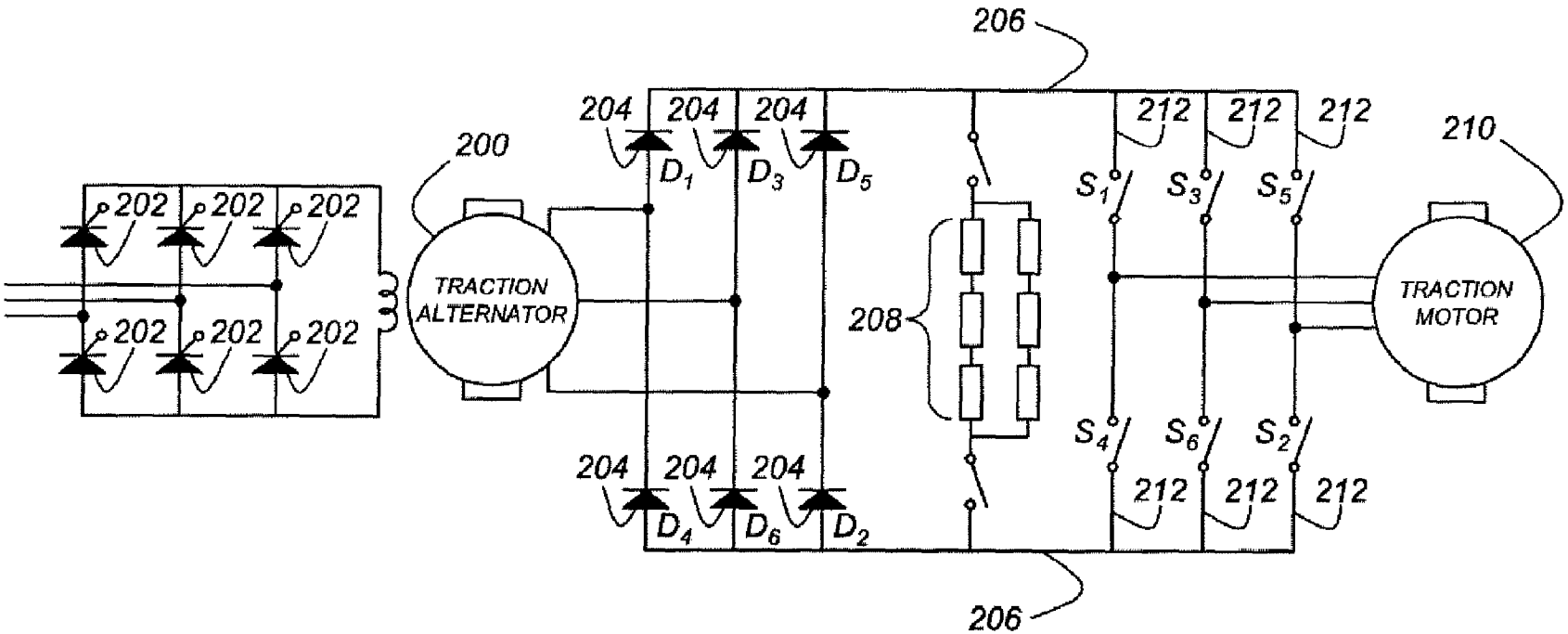
FIG. 4 illustrates a typical traction drive which is useful in an emergency shutdown system configured according to an embodiment of the present invention.

FIG. 4 shows a typical traction drive used in heavy haul applications such as locomotives and mining equipment that may be configured for use in embodiments of the present invention.

Referring to FIG. 4, traction alternator 200 is directly driven by an engine, such as engine 10 (not shown). The alternator field is controlled by phase controlled rectifiers (AC to DC converters) 202. The output of alternator 200, which is rectified by rectifiers 204, supplies DC current through bus 206. Resistor bank 208, connected to bus 206, is used to dissipate braking energy. A traction motor, 210, and a drive depicted as a number of electronically controlled inverter switches S1-S6, is also connected to DC bus 206. Those skilled in the art will appreciate in view of this disclosure that the present method and system could be employed with equipment having one, two, or many traction motors.

The DC link voltage can be controlled by choppers (not shown). Choppers are not used universally, often because of added expense and because DC current is often available from onboard batteries, such as battery 72. Even if choppers are used, traction inverters may be used to control the maximum power transfer. For example, when resistor bank 208 and traction motor 210 are connected, if the operating point is at v2 in the graph of FIG. 8, then traction inverter switchess $S_1$-$S_6$ (shown at 212 in FIG. 4), are controlled so that motor 210 transiently produces more motoring torque, so as to bring the DC link voltage from v2 to v1. Because the time required to bring the engine speed to an acceptable level is less than a few seconds and may be even a fraction of second, the effect of transient traction load is minimal. On the other hand, if the operating voltage is v3, then the traction load is reduced so as to bring the voltage to v1 from v3. In some cases traction motor 210 may have to be driven even into braking. In this case, resistor bank 208 will dissipate the power from engine 10, which drives alternator 200, as well as power from traction motor 210.

Figure 5:
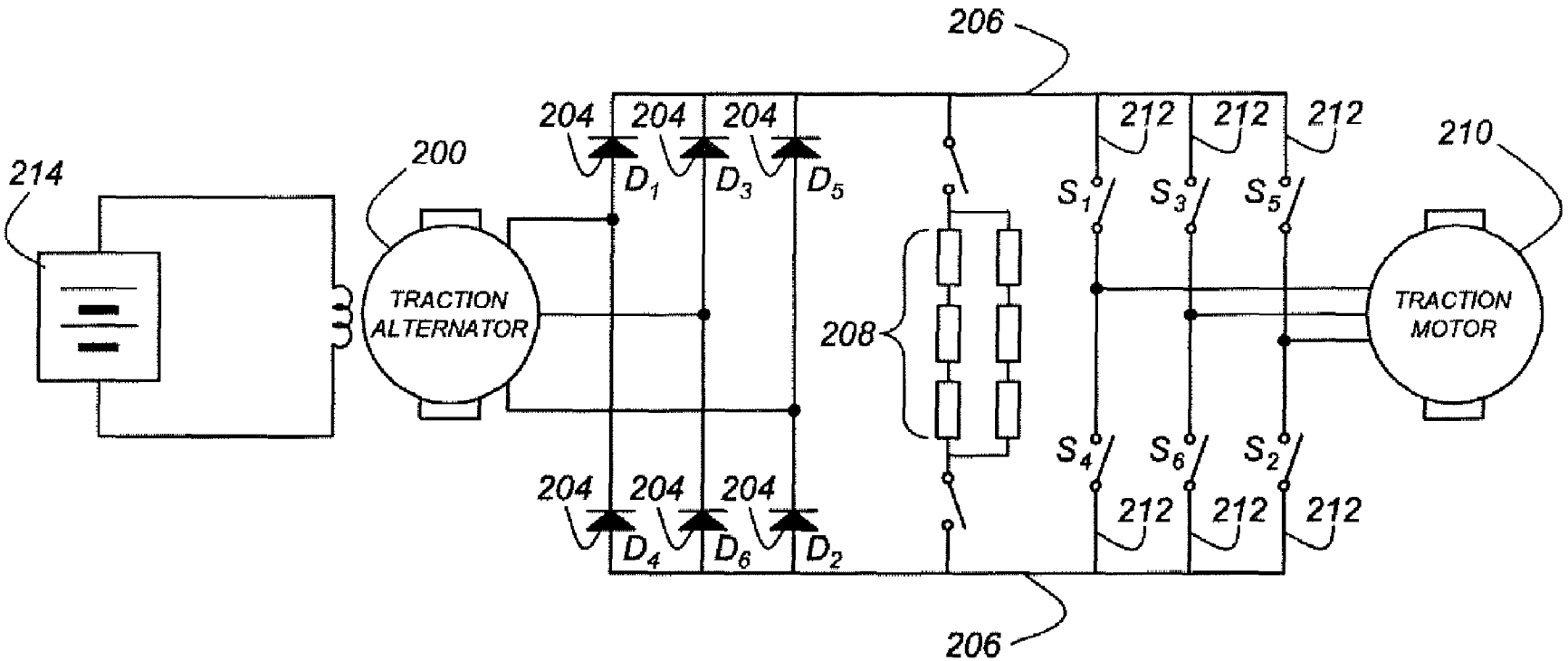
FIG. 5 illustrates a typical DC powered source for an alternator field current control according to an embodiment of the present invention.

FIG. 5 shows a traction drive similar to that of FIG. 4, except that the field control is replaced by DC source, 214. Although battery 214 is shown, any DC source could be used.

Figure 6:
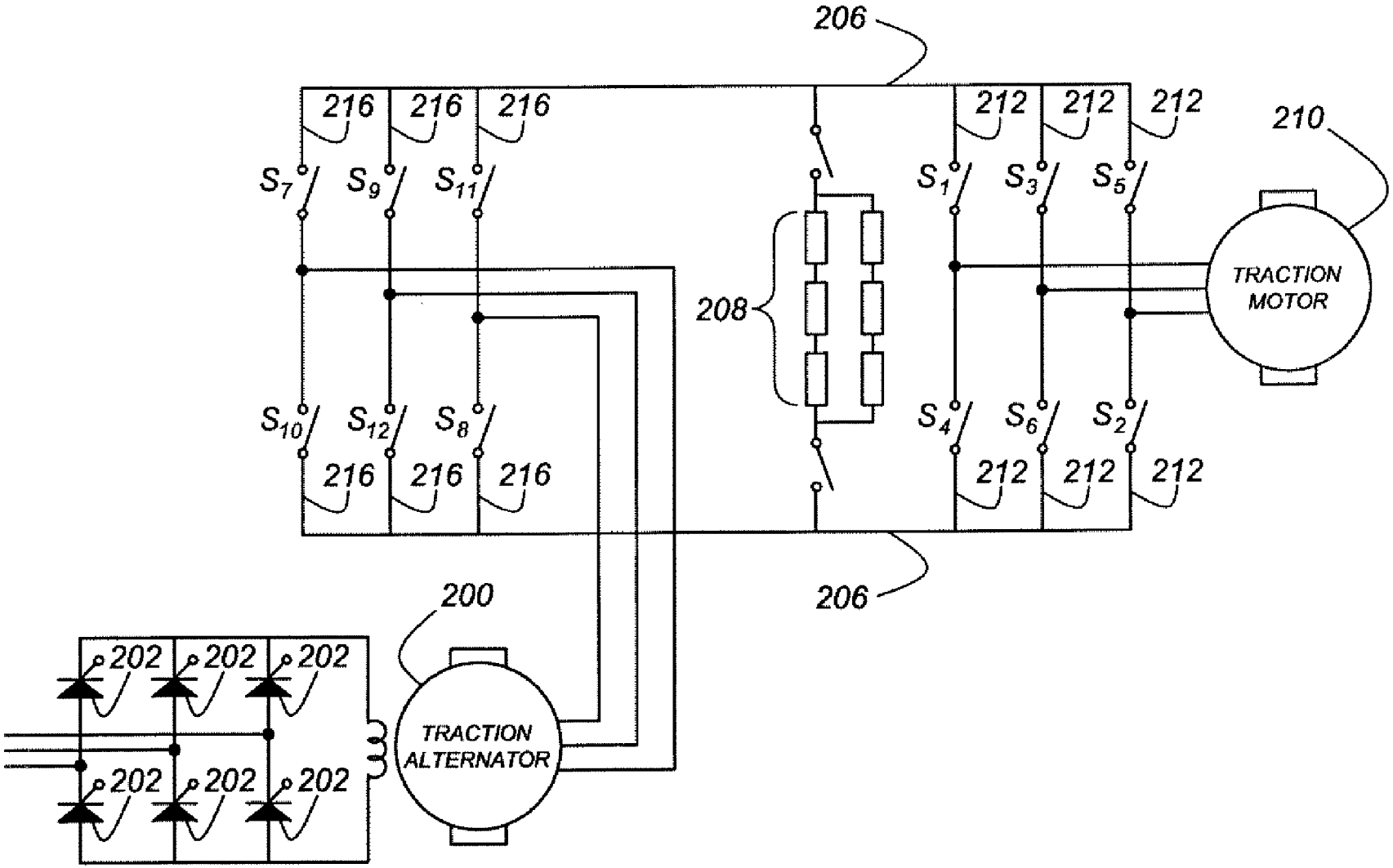
FIG. 6 illustrates another embodiment of a system using an alternator to load an engine during an emergency shutdown.

FIG. 6 shows another embodiment of a method and system for controlling engine shutdown through an alternator/traction motor system. In this case, unlike those of FIGS. 4 and 5, the output of alternator 200 is connected to a controlled rectifier depicted as a number of electronically controlled switches S7-S12 shown at 216. Switches S7-S12 are employed as a phase controlled, electronic rectifier in a step-down mode if the DC link voltage needs to be brought down or a three phase pulse width modulated rectifier if the DC link voltage needs to be increased. In this case, when the DC link voltage is changed, the power consumed by the resistor bank 208 and the power flow from alternator 200 is also changed. In this configuration, resistor bank 208 and its control, the traction motor drive, the alternator output rectifier and the alternator field current could all be controlled to get the maximum power transfer from alternator 200 so as to bring the engine speed down as fast as possible. Also in this configuration, the engine, such as engine 10, can be brought down to very low speeds and can even be driven in the opposite direction. The DC voltage may be kept high because electronic rectification is not dependent upon the output voltage from alternator 200.

Figure 7:
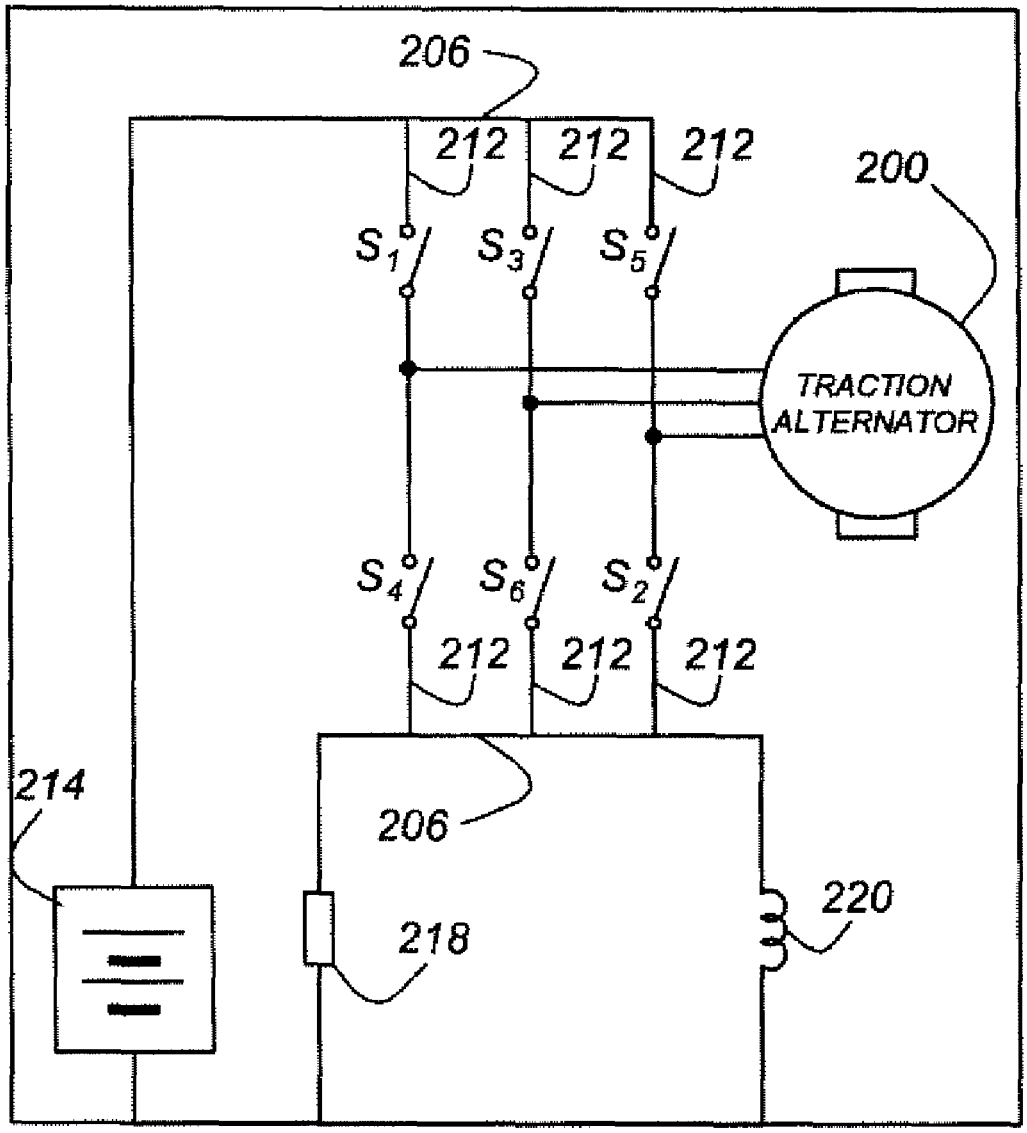
FIG. 7 illustrates use of a cranking system to stop an engine according to another embodiment of the present invention.

As the engine speed comes down, a cranking configuration may be used to regulate the DC link voltage, with the alternator inverter being controlled to produce the maximum torque. This type of control, as shown in the embodiment of FIG. 7, can be used to generate and control high torques at low engine speeds. This configuration may also be used to bring the engine speed to zero. In the embodiment of FIG. 7, battery 214 is the cranking battery. Resistor 218 represents the external resistance of alternator 200, and inductor 220 represents the inductance of the field of alternator 200. This cranking configuration is very effective at lower speeds in the range of 20-30 rpm, and could be use exert cranking torque upon engine 10 in a reverse direction, which will rapidly stop engine 10.

The quick shutdown capability afforded by alternator 200, either with or without assistance from traction motor 210, may be used in case of engine operating impairment or abnormal operating conditions other than fugitive fueling. Such impairments, as well as unwanted operating conditions having the potential for causing engine damage, could be detected by monitoring such engine operating parameters as turbocharger speed, turbocharger inlet temperature, intake manifold temperature, intake manifold pressure, exhaust temperature, oil pressure and/or temperature and/or flow, fuel pump operation, fuel pressure/flow, fuel injector and control operation, engine speed, crankcase pressure, coolant flow, coolant temperature, vibration, and other operating parameters.

Figure 8:
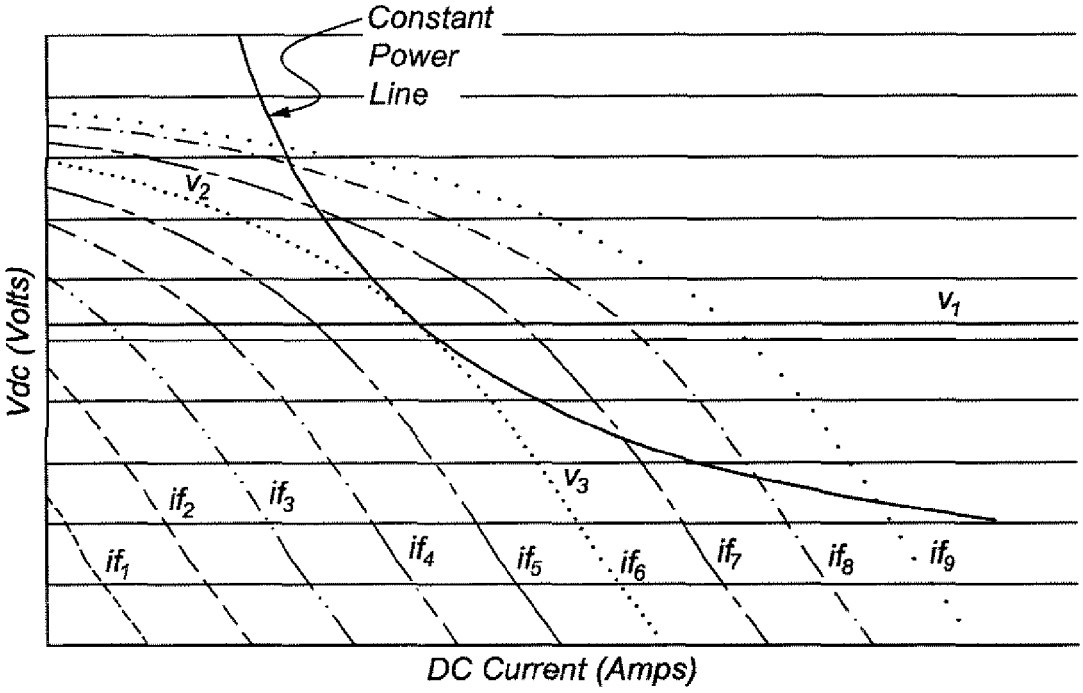
FIG. 8 is a graph illustrating several of operating characteristics of an alternator configured according to an embodiment of the present invention.

FIG. 8 illustrates various alternator system operating characteristics. Voltage/current characteristics for different alternator field currents (if1, if2 . . . if9) are shown. A constant power line is also shown. In the example of FIG. 8, the maximum power can be transmitted when the DC link voltage is at level v1, for a given field current of if6. If the voltage is above or below this level, the power delivered by the alternator (and therefore, the torque applied to bring the engine speed down) is reduced. There are three methods that can be used to control the power. The first method is controlling the field current. Generally, the higher the field current, the greater the power transfer. In general, this method has a slower response characteristic due to the large inductance typically present in the field. Moreover, the phase controlled rectifier control generally loses synchronization if the input frequency changes too fast. This may happen if the engine is slowing down quickly. Therefore, in the emergency shutdown mode, SCRs 202 are continuously fired (without regard to synchronization) until the maximum field current is produced. As noted above, the power transfer is maximized by optimizing the DC link voltage.

While particular embodiments of the invention have been shown and described, numerous variations and alternate embodiments will occur to those skilled in the art. Accordingly, it is intended that the invention be limited only in terms of the appended claims.

The invention claimed is:

1. A system for detecting and responding to fugitive fueling of an internal combustion engine, comprising:

a fuel supply system configured to furnish fuel to the engine during a period of time;

an engine output measuring device for determining the engine's work output during said period of time; and a controller operatively connected with the fuel supply system and said engine output measuring device, with the controller predicting a quantity of fuel which the engine should consume during the period of time, based upon the engine's work output, with the controller comparing an actual quantity of fuel furnished by said fuel supply system during said period of time with the engine's work output during said period of time, and with said controller setting a fugitive fueling flag when the furnished quantity of fuel is less than the predicted quantity of fuel.

2. The system of claim 1, wherein the controller directs the fuel supply system to reduce the flow of fuel to the engine in the event that that the fugitive fueling flag is set.

3. The system of claim 1, wherein the controller is configured to periodically command the fuel supply system to change the fuel rate, while determining the engine's resulting change in work output, so as to determine the engine's responsiveness to changes in fuel rate, with said controller setting said fugitive fueling flag if the engine's work output does not change in accord with a commanded change in the fuel rate.

4. The system of claim 1, wherein the controller monitors the engine's fuel rate and work output during normal load transients, to determine the engine's responsiveness to changes in fuel rate, with the controller setting the fugitive fueling flag if the engine's work output does not change in accord with a commanded change in the fuel rate.

5. The system of claim 1, wherein said controller directs said fuel supply system to shut off fuel to the engine when said fugitive fueling flag is set, with the controller thereafter engaging an emergency shutdown system in the event that the engine does not stop when the fuel is shut off.

6. The system of claim 5, wherein said emergency shutdown system comprises a rotating electrical machine coupled to the engine, said rotating electrical machine having sufficient power absorbing capacity to stop the engine.

7. The system of claim 5, wherein said emergency shutdown system comprises an air shutter configured to for cut off a flow of combustion air to the engine.

8. The system of claim 5, wherein said emergency shutdown system comprises a system for introducing an inert gas into the engine, to exclude combustion air from the engine's cylinders.

9. The system of claim 1, wherein said engine output measuring device comprises a rotating electrical machine coupled to the engine, with said rotating electrical machine coupled to a variable and controllable load, such that the rotating electrical machine is operable as a dynamometer.

10. The system of claim 1, wherein said fuel supply system further comprises at least one sensor for directly measuring the fuel consumed by the engine during a period of time.

11. The system of claim 1, wherein said controller directs said fuel supply system to shut off fuel to the engine and engages an emergency shutdwn system if said fugitive fueling flag is set.

12. The system of claim 1, wherein said engine comprises a reciprocating internal combustion engine.

13. A method for detecting and responding to fugitive fueling of a reciprocating internal combustion engine, the method comprising:

measuring the fuel consumed by the engine during a period of time;

determining the engine's work output during said period of time;

predicting the quantity of fuel which the engine should consume during said period of time, based upon the engine's work output;

comparing the actual quantity of fuel consumed during said period of time with the engine's work output during said period of time; and initiating a fugitive fueling response in the event that the actual quantity of fuel consumed is less than the predicted quantity of fuel.

14. The method of claim 13, wherein the step of initiating a fugitive fueling response comprises the steps of:

commanding the engine's fuel system to shut off the flow of fuel to the engine; and engaging an emergency shutdown system in the event that the engine does not stop in response to the shut off of fuel to the engine.

15. A method for detecting and responding to fugitive fueling of a reciprocating internal combustion engine having its crankshaft coupled to a rotating electrical machine, comprising:

measuring the fuel consumed by the engine during a period of time;

determining the engine's work output during said period of time by operating said rotating electrical machine as a virtual dynamometer;

predicting the quantity of fuel which the engine should consume during said period of time, based upon the engine's work output;

comparing the actual quantity of fuel consumed during said period of time with the engine's work output during said period of time; and initiating a fugitive fueling response in the event that the actual quantity of fuel consumed is less than the predicted quantity of fuel, with the initiation of the fugitive fueling response comprising the steps of:

commanding the engine's fuel system to shut off the flow of fuel to the engine; and engaging an emergency shutdown system in the event that the engine does not stop in response to the shut off of fuel to the engine, with said emergency shutdown system comprising loading the engine by means of the rotating machine sufficiently to stop the engine.

16. The method of claim 15, wherein said internal combustion engine is installed in a railroad locomotive.

17. A method for detecting and responding to fugitive fueling of a reciprocating internal combustion engine having its crankshaft coupled to a rotating electrical machine, the method comprising:

measuring the quantity of fuel furnished to the engine by a fuel system during a period of time;

predicting the engine's power output during said period of time, based upon the quantity of fuel consumed;

determining the engine's actual power output during said period of time by operating said rotating electrical machine as a virtual dynamometer;

comparing the engine's actual power output with the predicted power output; and initiating a fugitive fueling response in the event that the actual power output exceeds the predicted power output.

18. The method of claim 17, wherein the step of initiating a fugitive fueling response comprises:

commanding said fuel system to shut off fuel to the engine; and in the event that the engine does not stop after the fuel is shut off, loading the engine by means of the rotating electrical machine sufficiently to stop the engine.

* * * * *